US011719432B2

(12) United States Patent
Lucas et al.

(10) Patent No.: US 11,719,432 B2
(45) Date of Patent: Aug. 8, 2023

(54) CONTAINERIZED EXPEDITIONARY SOLID WASTE DISPOSAL SYSTEM

(71) Applicant: Eco Burn Inc., Burlington (CA)

(72) Inventors: Jean Lucas, Burlington (CA); Jun Xiao, Burlington (CA); Carlos Murillo, Burlington (CA)

(73) Assignee: ECO BURN INC., Burlington (CA)

( * ) Notice: Subject to any disclaimer, the term of this patent is extended or adjusted under 35 U.S.C. 154(b) by 140 days.

(21) Appl. No.: 17/202,046

(22) Filed: Mar. 15, 2021

(65) Prior Publication Data

US 2021/0207800 A1 Jul. 8, 2021

Related U.S. Application Data

(63) Continuation of application No. 16/393,699, filed on Apr. 24, 2019, now Pat. No. 10,969,099.

(51) Int. Cl.

| | |
|---|---|
| ***F23G 5/40*** | (2006.01) |
| ***F23G 5/00*** | (2006.01) |
| ***F23G 5/12*** | (2006.01) |
| ***F23G 5/38*** | (2006.01) |
| ***F23G 5/46*** | (2006.01) |

(52) U.S. Cl.

CPC ..... *F23G 5/40* (2013.01); *F23G 5/006* (2013.01); *F23G 5/12* (2013.01); *F23G 5/38* (2013.01); *F23G 5/46* (2013.01); *F23G 2200/00* (2013.01); *F23G 2203/601* (2013.01); *F23G 2203/70* (2013.01); *F23G 2204/103* (2013.01); *F23G 2206/00* (2013.01); *F23G 2900/50001* (2013.01)

(58) Field of Classification Search

None

See application file for complete search history.

(56) References Cited

U.S. PATENT DOCUMENTS

| | | | | |
|---|---|---|---|---|
| 2009/0126600 | A1* | 5/2009 | Zupancich | B61D 17/10 220/592.2 |
| 2010/0129691 | A1* | 5/2010 | Dooher | C01B 3/34 422/600 |
| 2011/0048244 | A1* | 3/2011 | Wiker | A21B 1/245 99/443 C |
| 2011/0243802 | A1* | 10/2011 | Ringheim | C10J 3/26 422/186.04 |
| 2014/0065028 | A1* | 3/2014 | Hue | C10K 1/004 422/187 |

FOREIGN PATENT DOCUMENTS

| | | | |
|---|---|---|---|
| FR | 2 257 206 | 8/1975 | F23G 5/16 |

* cited by examiner

*Primary Examiner* — Jason Lau

(74) *Attorney, Agent, or Firm* — Slayden Grubert Beard PLLC

(57) ABSTRACT

The embodiments described relate to an expeditionary solid waste disposal system configured to improve logistics and enable it to be readily deployed. The two-stage gasification/oxidation process takes place in a dual chambered device that resembles and functions as a shipping container. Incinerators or other waste conversion devices are commonly containerized by loading the equipment into a standard or modified shipping container. This apparatus is designed as a waste conversion unit that integrates all of the necessary features required to be an ISO-certified shipping container within its structural design such that the waste conversion system and shipping container are one and the same. With correct set-up by 2 persons aided by forklift the system can be configured and operational in a matter of hours.

17 Claims, 7 Drawing Sheets

CONTAINERIZED EXPEDITIONARY SOLID WASTE DISPOSAL SYSTEM

RELATED APPLICATIONS

This application is a Continuation of U.S. patent application Ser. No. 16/393,699 filed Apr. 24, 2019, the entire contents of which are incorporated herein.

TECHNICAL FIELD

The embodiments presented relate to an expeditionary solid waste disposal system configured to improve logistics and enable it to be readily deployed in a military or civilian environment.

BACKGROUND

Many workforce camps, humanitarian and refugees' camps and military bases have difficulty safely and efficiently disposing of solid waste. The logistical challenges presented by the austere locations and often severe climatic conditions have made traditionally configured incinerators impractical. Without the option for better methods many have been forced to utilize crude and polluting disposal methods such as burn pits and small, ineffective incinerators that were not purpose-built.

In particular, rural and limited-access regions, have less infrastructure and cannot properly dispose of waste. Land disposal of waste is not appropriate in many areas due to topographic, hydrogeological, and/or climatic conditions. If waste is not properly disposed of, serious health conditions and environmental impacts may arise. Incinerators offer a possible solution. However, many current systems are difficult to transport and require too many resources which are not available in remote locations.

SUMMARY OF THE INVENTION

This summary is provided to introduce a variety of concepts in a simplified form that is further disclosed in the detailed description. This summary is not intended to identify key or essential inventive concepts of the claimed subject matter, nor is it intended for determining the scope of the claimed subject matter.

Embodiments described herein provide an expeditionary solid waste disposal system configured to resemble a standard-type shipping container and having the physical characteristics that allow it to meet ISO (international standards organization) transportation requirements (i.e., iso-container) to enable transport using multiple modes and convenient assembly. The presented embodiments provide a portable and readily assemblable apparatus comprised of a plurality of combustion chambers which may be aligned and connected using integrated ISO corner blocks, four-way forklift pockets, container connecting/locking devices and slide rail mechanisms within a portion thereof. The plurality of combustion chambers is configured to provide a multi-stage close coupled gasification, followed by oxidation of the gaseous effluent then direction of the gases to either the main exhaust stack or heat recovery module, if being used.

In one aspect, the front side is approximately 2,438 millimeters in width. Further, the right-side wall is opposite to a left side wall that has a length of 1,969 millimeters and includes a height of approximately 2,438 millimeters.

In one aspect, the apparatus is ISO-certified to allow for 9-high stacking during marine transportation. The apparatus is also able to operate or be stored in harsh conditions including high-moisture, corrosive, extreme heat, extreme cold, desert sands, and windy environments without corrosion or degradation.

In one aspect, the apparatus enables an integrated mating duct between a first and second chamber to allow fluid to flow between a first chamber and second chamber under natural draft created by the exhaust stack or by induced draft created by a variable speed motor blower. A primary burner and a primary blower (i.e., fan) are in communication with the first combustion chamber and a secondary burner and secondary blower (i.e., fan) are in communication with the second combustion chamber.

In one aspect, in some embodiments the control panel includes a switch to turn on or off the blackout operation mode. In blackout mode the no electronic lights will be emitted, and audio sounds will be disabled at a minimum.

In one aspect, the apparatus is configured to be transported by an aircraft, a shipping vessel, a train, or a vehicle. Further, the apparatus can be lifted using a forklift during an operation, transport, or storage configuration.

In another aspect, the exhaust stack is stackable for use and unstackable for storage The fuel bladder is collapsible for storage and fillable for use, using standard methods of fuel transfer.

Other aspects, advantages, and novel features of the embodiments will become apparent from the following detailed description in conjunction with the drawings.

BRIEF DESCRIPTION OF THE DRAWINGS

A more complete understanding of the embodiments and the advantages and features thereof will be more readily understood by reference to the following detailed description when considered in conjunction with the accompanying drawings wherein.

DETAILED DESCRIPTION

Figure 1:
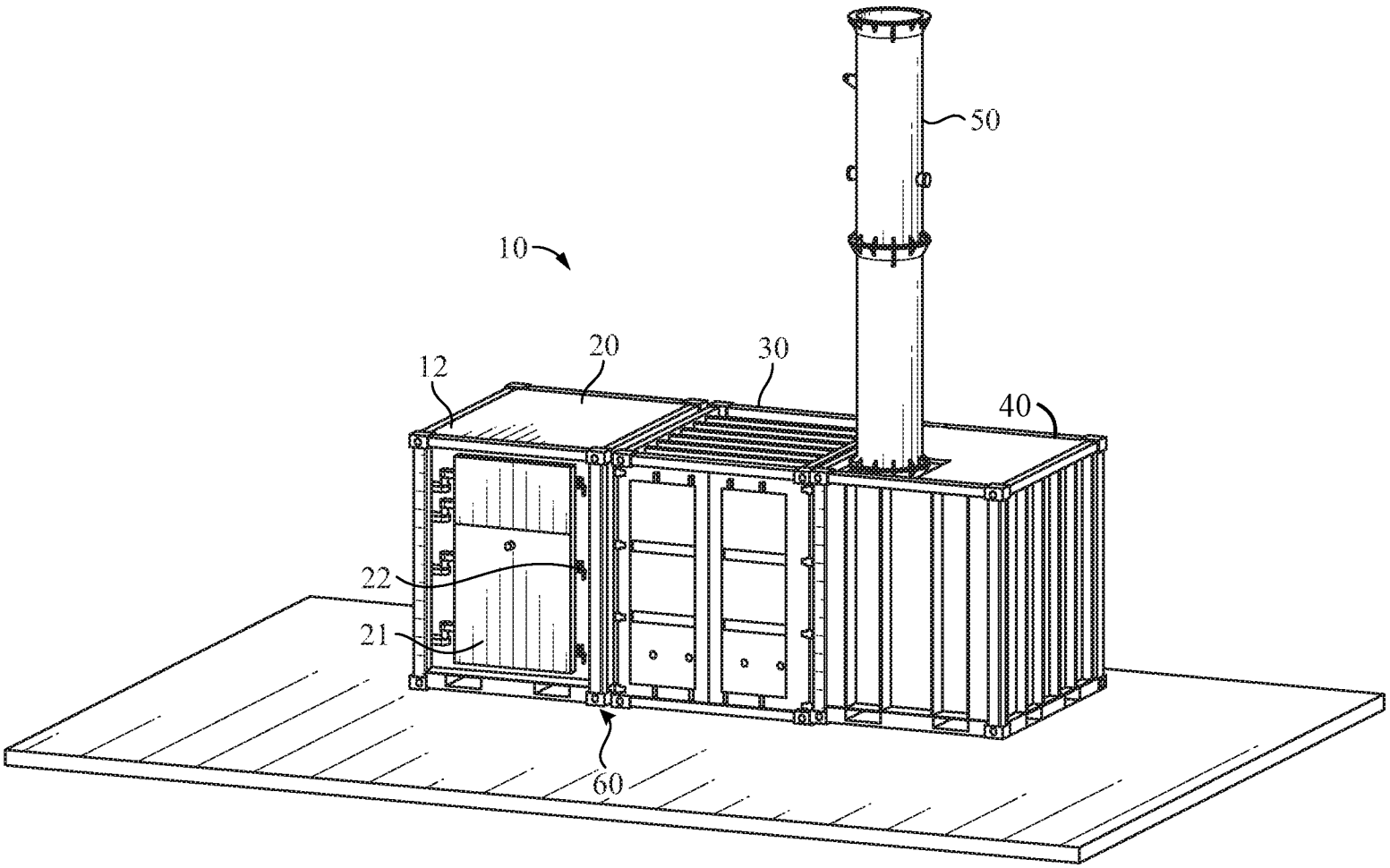
FIG. 1 is a perspective view of a containerized expeditionary solid waste disposal system set-up in operational configuration according to some embodiments.

The specific details of the single embodiment or variety of embodiments described herein are to the described system and methods of use. Any specific details of the embodiments are used for demonstration purposes only and not unnecessary limitations or inferences are to be understood therefrom.

Before describing in detail exemplary embodiments, it is noted that the embodiments reside primarily in combinations of components related to the system and method. Accordingly, the system components have been represented where appropriate by conventional symbols in the drawings, showing only those specific details that are pertinent to understanding the embodiments of the present disclosure so as not to obscure the disclosure with details that will be readily apparent to those of ordinary skill in the art having the benefit of the description herein.

As used herein, relational terms, such as "first" and "second" and the like, may be used solely to distinguish one entity or element from another entity or element without necessarily requiring or implying any physical or logical relationship or order between such entities or elements.

Specifically, the apparatus enables gasification and oxidation using a plurality of proprietary combustion chambers connected via an air duct and controlled using burners, variable speed blower, air dampers and microprocessor-controlled automation which enables two-stage gasification and oxidation.

The embodiments provide a highly portable and readily assemblable containerized waste conversion apparatus which enables recovered heat from gaseous effluent to be converted to a plurality of energy sources using releasably attached energy generation systems. The apparatus includes at least a primary and secondary combustion chamber, breech/control chamber, and heat recovery module chamber which are releasably secured to one another using a locking mechanism and collectively affixed to an integrated skid type base. The apparatus is designed to enable a single person with a forklift operator to releasably attach each iso-container using the container connecting devices, and releasably attach each interconnecting air duct, and blower and burner using an integrated slide rail system, quick connection cables and hoses without the need for a crane.

The apparatus is controlled by a microcontroller having integrated storage and remotely connected to the main control panel housed within the control chamber. During operations, an operator may batch load up to 1000 pounds of waste per day within the first combustion chamber which provides for over a 96 percent reduction of the load waste mass. Upon completion of the time gasification/oxidation (i.e., burn cycle), the apparatus initiates a cool-down mode, once completed an operator is allowed to open the door to remove the ash collected. The door, in some embodiments includes a temperature-controlled door lock that prevents a person from being able to open the door until the internal temperature is below 90 degrees Celcius. The waste can include mixed, unsorted, non-hazardous solid waste on a consecutive daily basis including time for cooling between batches and routine maintenance such as ash removal activities.

In contrast to the present embodiments, traditional mobile waste processing systems are typically housed within a single 20-foot iso container and often require manual sorting of the solid waste before it is placed within a shredder for further mass reduction and homogeneity. The traditional system, which is constructed then housed within a commercial shipping container, is not able to utilize to entire shipping envelope as space for waste processing capacity or the oxidation of the gases. Therefore, inherent to the traditional design is a loss of up a minimum of 10% and up to 40% of the available shipping volume due to the redundancy of the outer shipping container. The apparatus has a unique construction whereby the wall of the primary and secondary combustion chambers are also the outer wall of the container and it is outfitted with all of the required shipping container features but without the addition of an outer shipping container, maximizing the internal volumes for the device allowing it process more waste and oxidize more gaseous by-products than is possible within the traditional configuration.

Referring now to the drawings wherein like referenced numerals designate identical or corresponding parts throughout the views. There is shown in FIG. 1 a mobile and readily assemblable containerized multi-stage waste-to-energy recovery apparatus 10. The apparatus 10 includes a plurality of combustion chambers 12 a microcontroller 16 remotely connected to main control panel 18. The portable apparatus 10 is dimensioned to be transported using a variety of transport platforms including at least a semi-trailer, ship, helicopter, or within the cargo bay of transport aircraft and readily assembled by a single person and a forklift operator on-site using the container locking mechanism 60 and tool 61.

The plurality of chambers 12 further includes at least a first combustion chamber 20, a second combustion chamber 40, a control chamber 30. Each of the plurality of equilateral dimensioned chambers 12 is approximately 8.0 feet wide, 6' feet and 5½ inches long, and 8.0 high with a steel exterior for strength coupled with lightweight insulating materials which reduce the weight of each compartment to 7,500-10,000 lbs.

The first combustion chamber 20 includes a ceramic fiber refractory lining 23 (further illustrated in FIG. 5) which is resistant to thermal shock due to the regular cycling from high temperatures during the burn cycle to low temperatures during the cooldown cycle that takes place in the first combustion chamber 20 during the close-coupled gasification. The dual chamber design of the first 20 and second combustion chamber 40 optimizes quality of the gaseous effluent by reducing the likelihood of release contaminants. The first 20 and second combustion chambers 40 are fluidly connected by an air duct 32 housed within the control chamber 30. The air duct, according to some embodiments, further connects an integrated variable speed, and in some embodiments, flow regulated, secondary blower 42 which creates a turbulent mixture of the contained air and gas molecules as they enter the secondary chamber where they are exposed to a minimum of 850 Degrees Celsius for a minimum of 2 seconds or 1000 Degrees Celsius for a minimum of 1 second allowing for complete oxidation of contained effluents. Before use, waste is batch loaded into the first combustion chamber 20 through the main door 21 where it is placed on a metal grate 28 above the ceramic firebrick floor surface 27 having at least one removable grate. Once the first combustion chamber 20 is fully loaded with waste, the main door 21 is closed and the plurality of safety features 22 are engaged to protect an operator by immediately terminating the gasification/oxidation.

A fuel tank which supplies the primary burner 24 and secondary burner 41 collapsible fuel tank that stores within the first combustion chamber 20.

Figure 2:
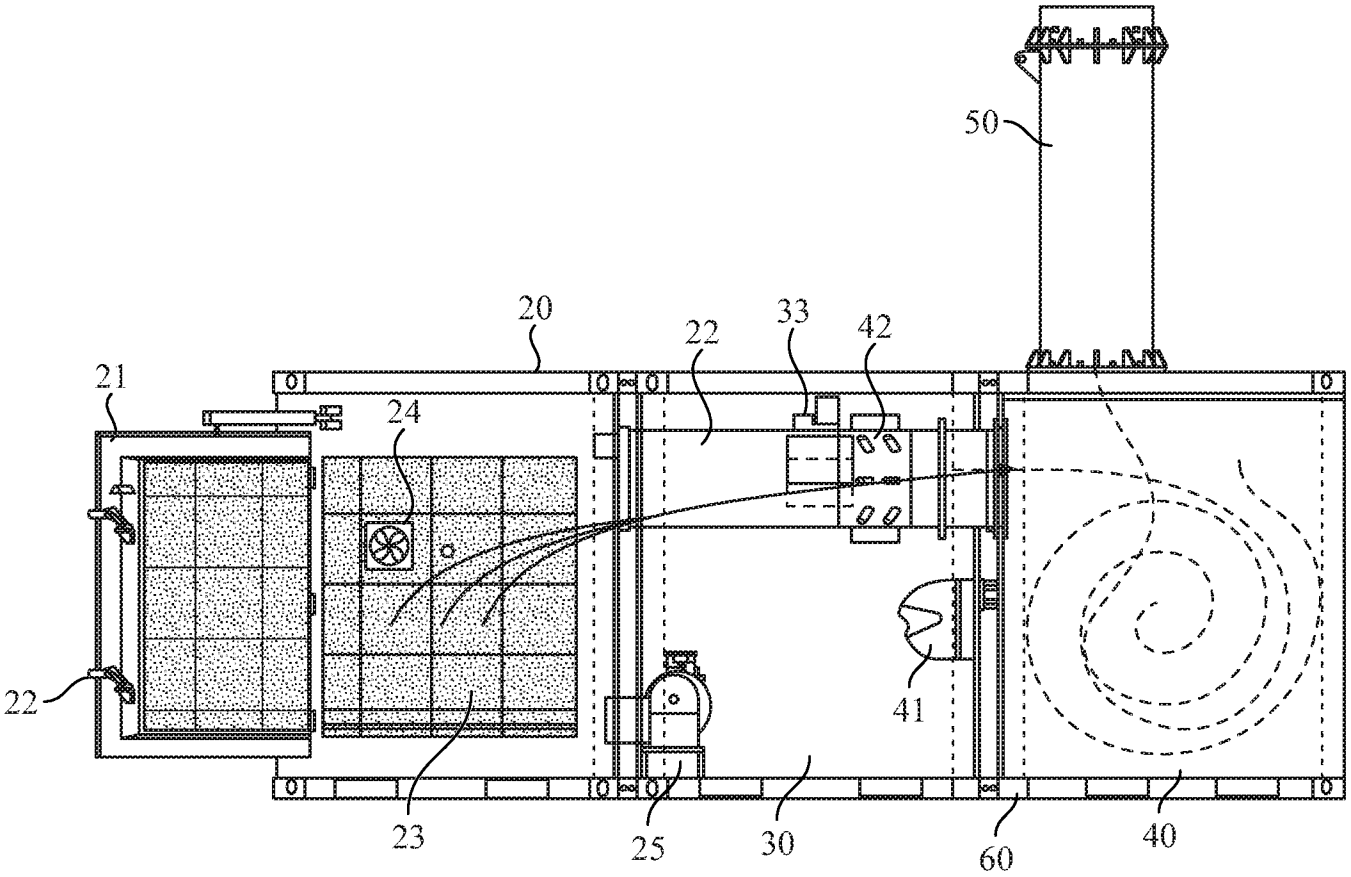
FIG. 2 is a cross-sectional view of a containerized expeditionary solid waste disposal system in operational configuration.

Shown in FIG. 2 is a cross-sectional view of the first combustion chamber 20 with the main door 21 open. The apparatus 10 is designed to enable a single operator to batch load up to one thousand pounds of waste through the main door 21. Once the waste is placed onto the metal grate 28 above the ceramic firebrick floor surface 27, the main door 21 is closed and the plurality of safety devices 22 are initiated. Shown in FIG. 7 the burn cycle may be started either automatically using a programmed cycle or manually operated at the main control panel 18. When the gasification/ oxidation process has begun, the microcontroller 16 provides a plurality of output commands to both the primary blower 25 and secondary blowers 42 which are electrically connected to a countdown timer 19 and programmed to run for a pre-determined period to ensure any residue from gaseous effluent has been exhausted within the first 20 and second combustion chambers 40 prior to lighting the secondary burner 41. Upon expiration of this pre-programmed "exhaust period," the secondary burner 41 is lit until the pre-programmed set point temperature of 850-1000 degrees Celsius is reached. The primary burner 24 is further controlled by the microcontroller 16 and configured to light once the pre-programmed set point temperature of 650-800-degree Celsius is reached within the primary (first) chamber 20.

During the gasification process, the loaded solid waste is first dried to remove any moisture within the waste and then begin to decompose any contained organic molecules to form a gas vapor composed of water, carbon monoxide, carbon dioxide, hydrogen, methane, and ethane, etc. Once the gasification process is complete, any remaining solid waste is removed along with the ash collected along the ceramic firebrick floor surface 27 and under the removable metal grate 28.

Figure 6:
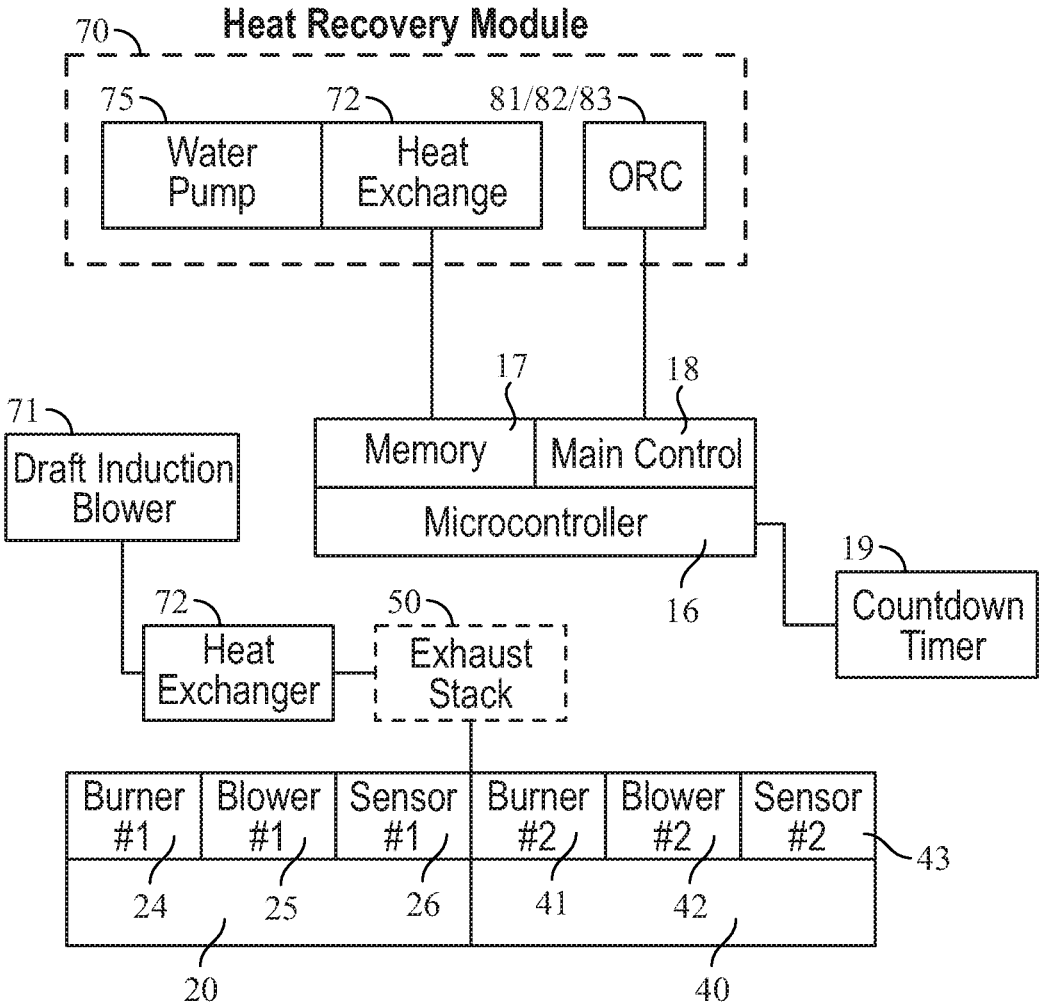
FIG. 6 is a block diagram of the microcontroller and control architecture, according to some embodiments.

Shown in FIG. 6, the primary burner 24 and primary blower 25 are electrically connected to at least one mounted sensor 26 which regulates the pre-programmed temperature of the first primary (first) chamber 20 by sending an output signal to the microcontroller.

Shown in FIG. 6, the at least one mounted sensor 43, for example thermocouple of the secondary combustion chamber 40 is further configured to regulate the pre-programmed set point temperature within the second combustion chamber 40 using a secondary blower 42 controlled by variable frequency drive, secondary burner 41 which modulates between 25%-100% (Low fire to high fire). An automatic air damper is activated by modular motor to help to control fresh air input.

Figure 3:
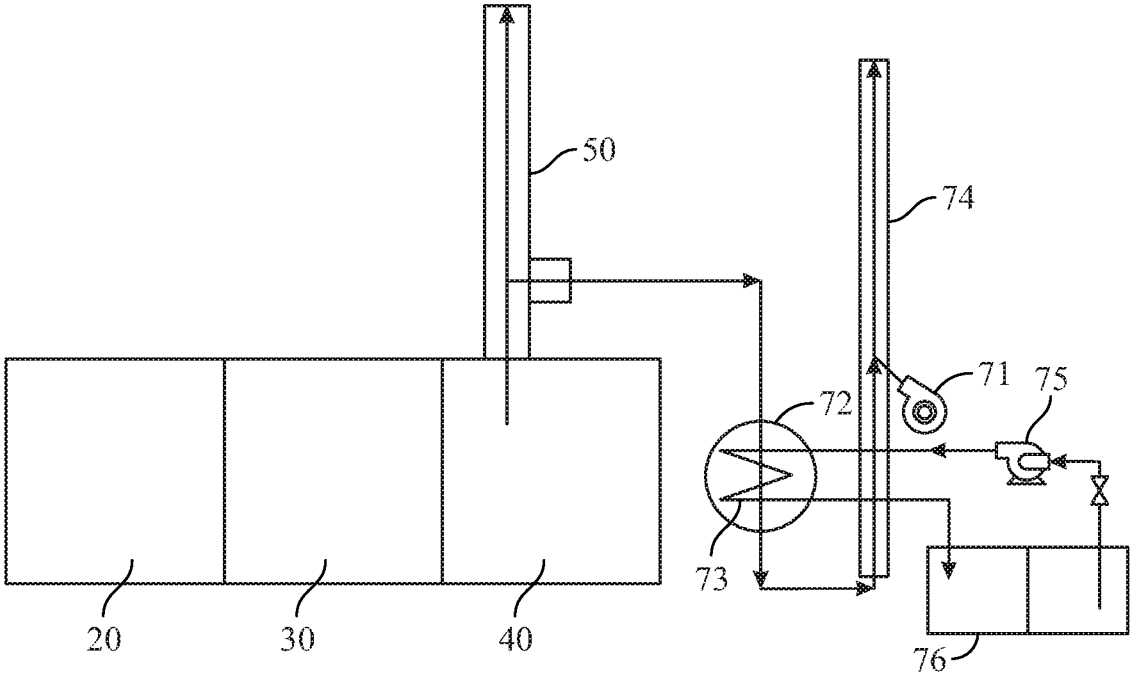
FIG. 3 is a schematic view of the apparatus including the releasably attached heat exchanger, according to some embodiments.

Shown in FIG. 3 When operating the apparatus 10 in a heat recovery mode, the gaseous effluent may be selectively directed using a draft induction blower 71 to heat exchanger 72 then discharges from a heat recovery exhaust stack 74. The heat exchanger 72 further includes a plurality of water coils 73 which are heated through convection and radiation, and the liquid contents circulated throughout the closed loop system using the water circulation pump 75. When configured in the heat recovery mode, the gaseous effluent is redirected from the heat recovery exhaust stack 74 to the main exhaust stack 50 once the at least 500-gallon capacity of the at least one water tank 76 is reached.

In some embodiments, the main exhaust stack 50 emits no visible emissions during operation and is shown to have low in-stack emissions. When the waste mixture is thermally destroyed, the remaining ash has no toxicity characteristics as defined by the US Environmental Protection Agency (EPA) regulations when subjected to the toxicity characteristic leachate procedure (TCLP).

Once the close-coupled gasification within the first 20 and second combustion chambers 40 are complete, the microcontroller 16 initiates a pre-programmed cool down cycle using the primary blower 25 and secondary blower 42 to exhaust any residue gas. Similar to the burn cycle which is operated with a countdown timer, the cool-down mode may be pre-programmed for a pre-selected period of time-based on factors such as operational tempo, climate, and operating conditions. For example, if the apparatus 10 is transported to a cold environment with minimal waste, both the burn cycle and cool down period may be shortened to preserve fuel consumption. Conversely, if transported to a tropical environment, the cooldown period may be extended to account for the warmer temperatures. Suitable fuels include diesel, or JP-8 fuel stored within the self-contained fuel system. The fuel bladder can be folded into the interior of the apparatus 10 during transportation.

Now shown in FIG. 3 is a schematic view of the apparatus 10 which is configured to provide a storable heated liquid when used in the heat recovery mode. During use in the heat recovery mode, the gaseous effluent is directed from the heat recovery module 70 to the heat exchanger 72 where the heat molecules communicate through convection and radiation with the plurality of water coils 73 to warm the contained liquid. Though it is contemplated the heat exchanger 72 is comprised of a plurality of water coils 73 which are heated using convection and radiation, the heat exchanger 72 may be further equipped with shell and tube exchangers, plates, with or without fins.

Further illustrated in FIG. 3 is a variable speed draft induction blower 71 within the heat recovery module 70 which creates fluid suction from the second combustion chamber 40 to the heat exchanger 72 and heat recovery exhaust stack 74. During the convection cycle, the gaseous effluent heats the contained liquid within the plurality of water coils 73 which is later transformed back to cool liquid at the cooling interface. The liquid is stored with the at least one water storage tank 76 then circulated by the circulation pump 75.

Figure 4:
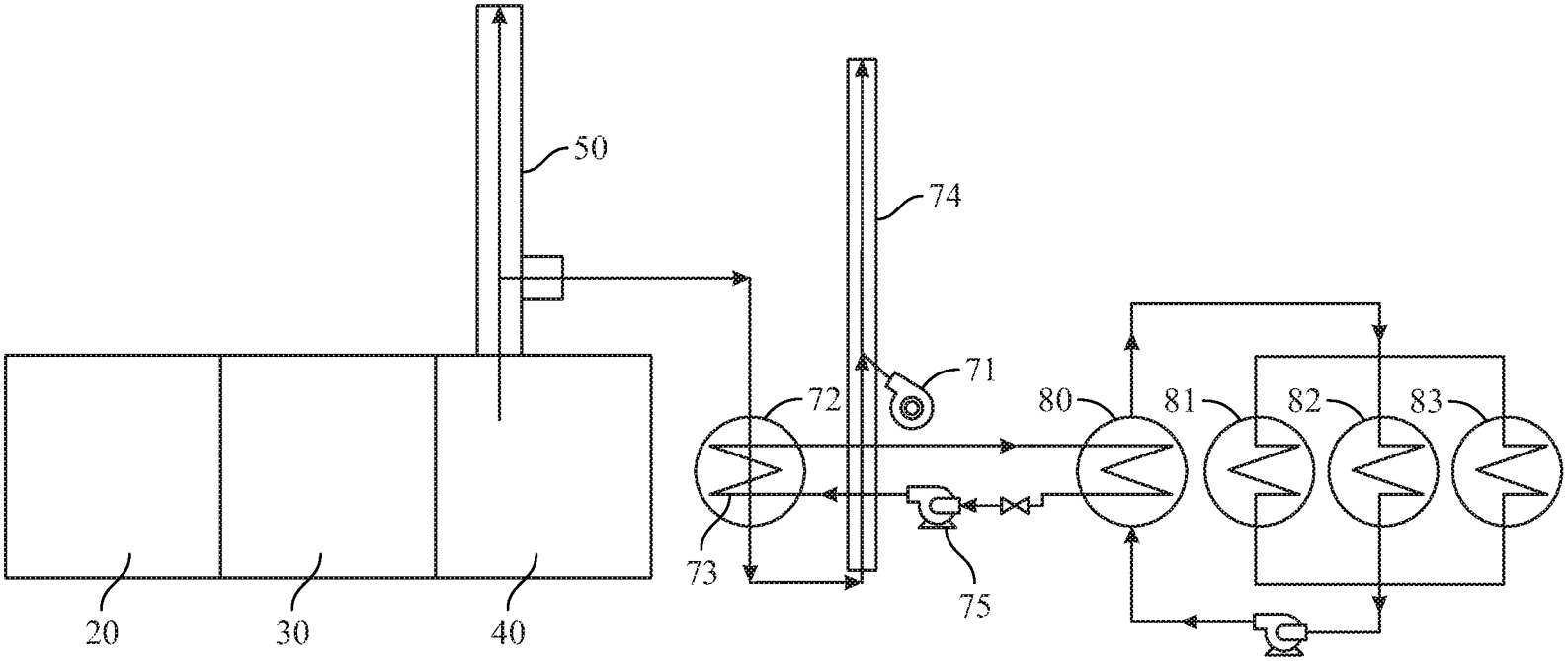
FIG. 4 is an alternative schematic view of the apparatus including the releasably attached thermoelectric generator, heat exchanger and organic Rankine cycle engine used to produce electrical power and heat, or and adsorption or absorption chiller to provide cooling, according to some embodiments.

Now shown in FIG. 4 is a schematic view of the apparatus 10 which enables a variety of water-to-energy mechanisms to be operated including a heat exchanger 72, and at least an organic Rankine cycle unit 81 or a absorption chiller 82, or a thermoelectric generator 83 to be used in conjunction with another heat exchanger 80. The heat exchanger 72 may be, but not limit to be shell and tube exchangers with or without fins, or heat pipe heat exchanger. The heat exchanger 80 may be, but not limit to be shell and tube exchangers with or without fins, plate and frame heat exchanger. The heat transfer medium runs between two heat exchanger 72 and 80 may be thermal oil, organic matter, water, or air.

Figure 5:
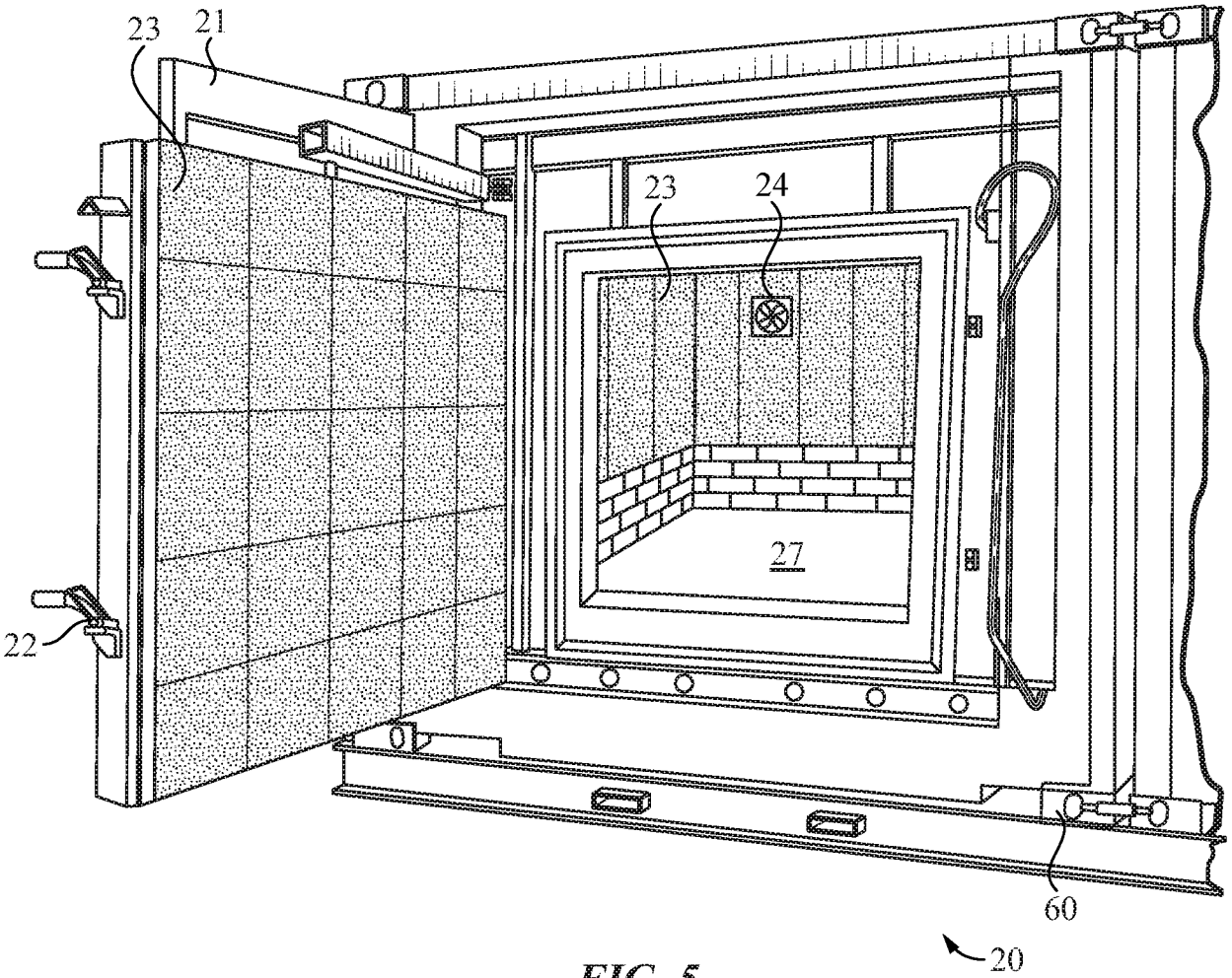
FIG. 5 is a detailed view of the first combustion chamber, according to some embodiments.

Now shown in FIG. 5 is a detailed view of the first primary (first) chamber 20 including the ceramic firebrick floor 27 and refractory lining 23. The first primary (first) chamber 20 weighs approximately 10,000 pounds and allows for convenient positioning using a forklift. The first primary (first) chamber 20 and is releasably coupled to the 7,500-pound control chamber 30 using a plurality of positionable locking components 60 which are attached about the steel corner blocks. During disassembly of the apparatus 10, the operator must first disconnect the primary blower 25 and secondary burner 41, and air duct 32 by the integrated sliding rail mechanism 33. Each of the interchangeable components of the apparatus 10 is designed for rapid "break down" without the need for heavy equipment.

FIG. 6 illustrates a block diagram of an exemplary configuration of the microcontroller 16 and the control architecture. Microcontroller 16 is in operable communication with a memory 17, and main control 18. The heat recovery module 70 includes pump 75, the heat exchanger 72, Organic Rankine Cycle (ORC) unit or absorption chiller 82, or thermoelectric generator 83 which are each in operable communication with the microprocessor 16. Draft induction blower 71 forces Flue gas to heat exchanger 72 and exit to stack 74.

Each iso-container utilized for the apparatus 10 is a certified ISO shipping container which meets all ISO 1496 requirements and U.S. Coast Guard requirements for safe containers. Each container can be transported via air, sea, rail, and ground and can be stacked nine containers high according to ISO standards. Each corner fitting conforms to ISO 1161 standards.

In some embodiments, the apparatus 10 is capable of being shipped by C-130 aircraft, CH-47D helicopter, CH-53 helicopter, or a sealift. The apparatus 10 may also be transported via integration with a military flat rack and loading onto a transport vehicle. To facilitate air transportation, the apparatus 10 is suitably balanced to facilitate lifting.

The apparatus 10 includes pressure regulation devices to control pressure differential during transportation. The apparatus 10 can regulate pressure during rapid decompression while in-flight, such a pressure drop of 8.3 PSI within 0.5 seconds or less.

Figure 7:
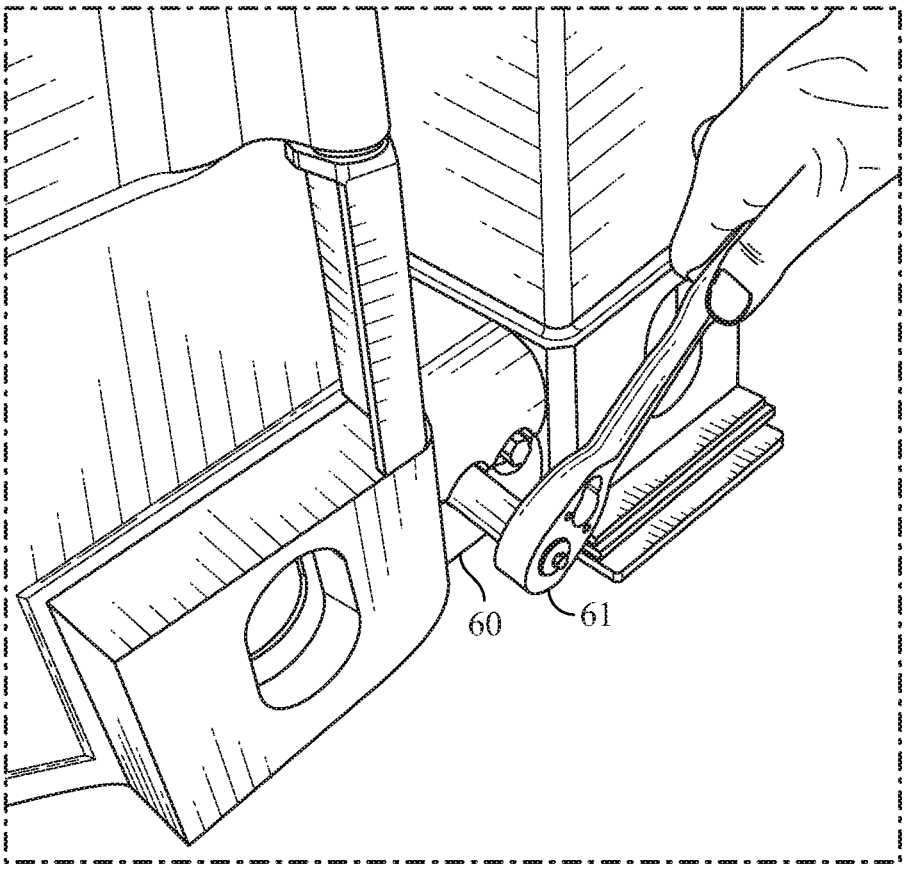
FIG. 7 illustrates an exemplary means of connecting the iso-containers via the connection component, according to some embodiments.

The configuration of the apparatus 10 allows for full assembly by two or more untrained individuals within 8 hours. FIG. 7 illustrates the connection of two or more iso-containers during the assembly of the apparatus using a tool 61 via a mechanical connection component 60. The apparatus 10 may utilize known means for the connection of iso-containers.

In some embodiments, once fully assembled the apparatus 10 can be position in an area measuring 20 feet by 40 feet or less. The area includes a buffer zone for waste loading, safety, and fuel storage. The ground where setup is executed should be less than a 6 percent grade.

In some embodiments, the apparatus 10 includes vaporproof and shatterproof lighting to allow nighttime operation and maintenance. The apparatus 10 further includes internal blackout capability to allow operation during blackout conditions. The blackout lighting components are capable of being set as a default operation mode.

In some embodiments, the apparatus 10 is provided with a plurality of fire extinguishers equipped with a tamperproof seal. The fire extinguishers may be rated for temperatures between −65-120° F.

In some embodiments, the exterior surface of each iso-container is chemical agent resistant painted to limit degradation and enhance safety. The apparatus 10 is capable of maintaining full operation during transportation, while stationary, or following long-term storage in harsh environments, such as a marine salt fog environment, without experiencing corrosion, rust, or similar forms of degradation. The apparatus 10 can withstand exposure to high-moisture environments without experiencing swelling, structural deterioration, operational failures, alterations, or other deformations.

Surfaces which experience temperatures above 140° F. as a result of inadvertent contact or 125° F. during handling as a result of incinerator function are appropriately guarded for contact by personnel.

Many different embodiments have been disclosed herein, in connection with the above description and the drawings. It will be understood that it would be unduly repetitious and obfuscating to literally describe and illustrate every combination and subcombination of these embodiments. Accordingly, all embodiments can be combined in any way and/or combination, and the present specification, including the drawings, shall be construed to constitute a complete written description of all combinations and subcombinations of the embodiments described herein, and of the manner and process of making and using them, and shall support claims to any such combination or subcombination.

An equivalent substitution of two or more elements can be made for any one of the elements in the claims below or that a single element can be substituted for two or more elements in a claim. Although elements can be described above as acting in certain combinations and even initially claimed as such, it is to be expressly understood that one or more elements from a claimed combination can in some cases be excised from the combination and that the claimed combination can be directed to a subcombination or variation of a subcombination.

It will be appreciated by persons skilled in the art that the present embodiment is not limited to what has been particularly shown and described hereinabove. A variety of modifications and variations are possible in light of the above teachings without departing from the following claims.

What is claimed is:

1. A mobile solid waste treatment system, comprising:

a transportable apparatus including a plurality of ISO containers configured to be releasably assembled together to define an ISO container assembly;

wherein the plurality of ISO containers includes:

a first ISO container comprising a primary combustion chamber and an outlet aperture, wherein the primary combustion chamber is configured for performing a gasification of the solid waste, and the outlet aperture is configured for output gasification products from the first ISO container;

a second ISO container comprising a secondary combustion chamber and an inlet aperture, wherein the inlet aperture is configured to receive the gasification products into the secondary combustion chamber for an oxidation of the gasification products; and a third ISO container configured for releasable assembly between the first and second ISO containers, the third ISO container including a gas flow duct to convey a gas flow, including the gasification products output from the primary combustion chamber in the first ISO container, to the secondary combustion chamber in the second ISO container for oxidation of the gasification products;

wherein the third container includes a burner;

wherein the plurality of ISO containers, including the first, second, and third ISO containers, include mechanical connectors for releasably securing the ISO containers to each other; and wherein each of the plurality of ISO containers individually, and the ISO container assembly, meet ISO container specifications defined by the International Organization for Standardization (ISO).

2. The system of claim 1, wherein the first ISO container has at least one first container wall that both (a) defines a wall of the primary combustion chamber for containing the gasification of the solid waste and (b) provides structural support for lifting the first ISO container.

3. The system of claim 2, wherein the second ISO container has at least one second container wall that both (a) defines a wall of the secondary combustion chamber for containing the oxidation of the gasification products and (b) provides structural support for lifting the second ISO container.

4. The system of claim 3, wherein:

each first container wall of the first ISO container is an exterior wall of the first ISO container; and each second container wall of the second ISO container is an exterior wall of the second ISO container.

5. The system of claim 4, wherein:

each first container wall includes refractory lining on an interior surface of the first container wall; and each second container wall includes refractory lining on an interior surface of the second container wall.

6. The system of claim 1, wherein each of the plurality of ISO containers has a rectangular prism shape.

7. The system of claim 1, wherein each of the plurality of ISO containers has the same height, width, and length dimensions.

8. The system of claim 1, wherein each of the plurality of ISO containers has a weight in the range of 7,500 to 10,000 lbs.

9. The system of claim 1, further comprising control electronics housed in a control chamber of the third ISO container, wherein the control electronics are configured to:

store at least one pre-programmed set point temperature; and control at least one burner to control a temperature in at least one of the primary combustion chamber or the secondary combustion chamber based on the at least one pre-programmed set point temperature.

10. The system of claim 1, wherein the burner included in the third container is configured to heat the secondary combustion chamber in the second ISO container.

11. The system of claim 1, wherein the primary and secondary combustion chambers are in fluid communication with an exhaust vent to provide gasification and oxidization of the solid waste.

12. A solid waste treatment system, comprising:

a transportable apparatus including a plurality of containers configured to be releasably assembled together to define a container assembly;

wherein the plurality of containers includes:

a first combustion container comprising a primary combustion chamber and an outlet aperture, wherein the primary combustion chamber is configured for performing a gasification of the solid waste, and the outlet aperture is configured for output of heated gasification products from the first combustion container;

a second combustion container comprising a secondary combustion chamber and an inlet aperture, wherein the inlet aperture is configured to receive the heated gasification products into the secondary combustion chamber for an oxidation of the gasification products; and a third container configured to be releasably assembled directly between the first and second combustion containers;

wherein the third container includes:

a gas flow duct extending across the third container and configured to receive the heated gasification products output from the first combustion container and convey a heated gas flow including the heated gasification products output from the first combustion chamber, to the second combustion chamber, for oxidation of the gasification products, via the inlet aperture of the second combustion container;

a slide rail mechanism configured to move the gas flow duct between a stored position and an operational position; and a blower associated with the gas flow duct and configured to increase the gas flow conveyed to the secondary combustion chamber; and wherein the plurality of containers include mechanical connectors for releasably securing the containers to each other.

13. The system of claim 12, wherein the blower associated with the gas flow duct is configured to create turbulence in the gas flow conveyed to the secondary combustion chamber.

14. The system of claim 12, wherein:

the first combustion container has at least one first container wall that both (a) defines a wall of the primary combustion chamber for containing the gasification of the solid waste and (b) provides structural support for lifting the first combustion container; and the second combustion container has at least one second container wall that both (a) defines a wall of the secondary combustion chamber for containing the oxidation of the gasification products and (b) provides structural support for lifting the second combustion container.

15. The system of claim 12, further comprising an additional blower provided in the third container and configured for communication with the primary combustion chamber via an aperture in a wall of the first combustion container.

16. The system of claim 12, further comprising a burner provided in the third container and configured to heat the secondary combustion chamber defined by the second combustion container.

17. A method of using a mobile solid waste treatment system, the method comprising:

releasably connecting a plurality of ISO containers together to define an ISO container assembly;

wherein each of the plurality of ISO containers individually, and the ISO container assembly, meet ISO container specifications defined by the International Organization for Standardization (ISO);

wherein the ISO container assembly includes:

a first ISO container comprising a primary combustion chamber and an outlet;

a second ISO container comprising a secondary combustion chamber and an inlet;

a third ISO container assembled directly between the first and second ISO containers, the third ISO container includes a gas flow duct extending from a first end aligned with the outlet of the first ISO container to a second end aligned with the inlet of the second ISO container;

combusting a solid waste in the primary combustion chamber, which generates heated flue gasses that are conveyed from the primary combustion chamber directly into the gas flow duct in the third ISO container and further conveyed from the gas flow duct to the secondary combustion chamber for oxidation of the heated flue gasses; and using a burner provided in the third ISO container to combust the heated flue gasses received in the secondary combustion chamber via the gas flow duct.

* * * * *